US005134778A

United States Patent [19]

MacCarthy

[11] Patent Number: 5,134,778

[45] Date of Patent: Aug. 4, 1992

[54] DESIGN-MAKING INSTRUMENT

[76] Inventor: Patrick MacCarthy, 5263 Arbutus St., Arvada, Colo. 80002

[21] Appl. No.: 508,966

[22] Filed: Apr. 13, 1990

[51] Int. Cl.[5] ..... B43L 11/06

[52] U.S. Cl. ..... 33/27.11

[58] Field of Search ..... 33/27.11, 27.07, 27.01, 33/27.09, 1 B, 1 K, 18; 434/84, 81, 85, 87, 88; 446/146

[56] References Cited

U.S. PATENT DOCUMENTS

| | | | |
|---|---|---|---|
| 3,280,792 | 10/1966 | Heyde | 434/84 X |
| 3,590,488 | 7/1971 | Padewicz | 33/27.11 |
| 3,629,971 | 12/1971 | Antell | 446/146 X |
| 3,834,070 | 9/1974 | Breslow | 33/27.11 X |
| 4,574,484 | 3/1986 | Borda | 33/27.11 X |

FOREIGN PATENT DOCUMENTS

| | | | |
|---|---|---|---|
| 19978 | 12/1956 | Fed. Rep. of Germany | 33/435 |
| 757141 | 10/1933 | France | 446/146 |
| 932777 | 12/1947 | France | 33/27.07 |

*Primary Examiner*—Harry N. Haroian

[57] ABSTRACT

A design-making instrument consisting of a rotatable wheel to which a sheet of paper or other material is attached. The paper may be rotated manually, mechanically, or electrically. A pen or other drawing means is applied to the surface of the rotating paper and this produces colorful designs. If the pen is held stationary while the paper is rotated, a circle is produced on the paper, unless the pen happens to be right at the center of rotation, in which case a point is produced. If the pen is moved radially while the paper is rotating, a spiral is produced, the clarity of which depends on the relative speed of radial movement of the pen and the angular velocity of the rotating paper. A spiral where successive revolutions are closely spaced resembles a set of concentric circles. Using this instrument, concentric circles in different colors may be produced on a sheet of paper. Nonconcentric circles may be produced by changing the center of rotation of the paper between drawing successive sets of circles. If the surface immediately underlying the paper contains a pattern consisting of elevated and depressed regions or due to holes in the surface, an image of the pattern is transferred to the paper by this instrument. Different designs can result from clockwise and counterclockwise rotations, and from using both directions of rotation on a single sheet of paper. Designs are produced rapidly with this instrument, and the act of producing the designs is interesting; the designs appear rapidly before one's eyes. Designs may also be prepared on a transparent sheet for projection onto a wall or screen. The wheel may consist of a plate and a replaceable template attached to said plate to increase the versatility of the instrument.

13 Claims, 4 Drawing Sheets

DESIGN-MAKING INSTRUMENT

FIELD OF THE INVENTION

This invention relates to the field of design-making instruments and design toys. More specifically, this invention pertains to a rotatable wheel mounted on a vertically disposed axis. A sheet of paper, or other material for drawing upon, is attached to the surface of the wheel and spins with the wheel. The wheel may be rotated directly by one's hand, or by some other mechanical means, or by an electric motor. While the wheel is rotating, a pen is touched against the surface of the paper, and that leads to the production of various designs on the paper. Colorful designs may be produced rapidly and simply with this device. The nature of the surface immediately underlying the paper has a major influence on the appearance of the design. If the surface is completely flat, the lines produced in a given segment are continuous and generally of a uniform intensity. If the underlying surface is uneven or irregular, the design produced is generally somewhat discontinuous, and varies in intensity. This is because the pen makes firm contact with the paper at points where the underlying surface is protruding and makes lighter contact where that surface is depressed or where there is a hole in the wheel. This effect produces very nice designs that have a wide variety of shades and hues even from a single pen. If the underlying surface contains a pattern composed of elevated and depressed sections or holes, an image of the pattern can be transferred to the overlying paper using this instrument.

BACKGROUND OF THE INVENTION

Making designs is a major activity in the play regime as well as in the education of children. One class of design-making toy involves producing designs on paper by means of pens or paint. There are a number of such design-making toys on the market which help children produce pleasant designs. For example, Binney and Smith (Easton, Pa.) and AMAV Industries (Montreal, Canada) market stencils that can be used to guide a pen or pencil in drawing predetermined designs. The well-known toy sold under the trademark SPIROGRAPH® by Kenner Products (Cincinnati, Ohio) allows a wide range of predetermined designs to be produced.

A number of companies (Ohio Art, Bryan, Ohio; Nasta Industries, Philadelphia, Pennsylvania; and Natural Science Ind., Ltd., Rockaway, N. Y.) manufacture a design-producing toy in which pain is dropped or poured onto a rotating surface. The wet paint spreads out radially on the surface due to centrifugal force and produces a radially-based design on the surface. With these instruments the user has little or no control over the nature of the design once the paint is dropped onto the surface. In the instrument of the present invention the pen can be removed from the surface of the paper by the user and repositioned on the surface at different radial distances to produce circularly-based designs. Also, the designs produced with the current commercial instruments based on centrifugal spreading of paint are not influenced by the nature of the underlying surface, and the manufacturers of these instruments generally supply stiff cardboard sheets rather than flexible paper sheets for producing the designs upon. With the present invention many styles of designs are possible based on the nature of the template that underlies the paper. With the present invention different designs can be produced from clockwise and counterclockwise rotation of the paper, a feature that is different from the instruments based on the centrifugal spreading of paint.

Methods for transferring images from templates to a sheet of overlying paper are already known in the prior art. For example, if a sheet of paper is placed on top of a coin and if the paper is then rubbed with a pencil, an image of the design on the coin is transferred to the paper. Toys based on this principle and using plastic templates with designs of monsters or girls' fashions have previously been marketed by Tomy Corporation (Carson, Calif.). With these commercial products, the template and paper are maintained stationary while a pencil or crayon is rubbed on the paper to produce a design. In these cases the designs produced are not circularly-based. With the present invention, the repetitive rubbing action is avoided because the paper is rotating; all that is required is that the user gently apply the pen to the surface of the rotating paper and change the radial position of the pen in a single sweep in order to "fill in" the design.

The instrument of the present invention provides a means for producing novel types of colorful designs rapidly and simply, by applying pens to rotating paper or other material. The nature of the designs produced depends on the angular velocity of the rotating paper, the speed of radial movement of the pen, on whether the paper is rotated clockwise or counterclockwise (or both), and on the nature or the surface immediately underlying the paper, as well as on other factors. The instrument of the present invention is neat and clean to use, unlike some toys that involve centrifugal spreading of paint where the paint splatters on the walls of the instrument requiring a clean-up after using the device.

DEFINITIONS

Wheel—Is defined as the rotatable section of the design-making instrument to which the means for drawing upon, such as paper, is attached. The wheel may have a substantially flat surface, or it may have an uneven surface. The wheel may be unitary, or alternatively, it may consist of a plate in combination with a template. The surface or face of a wheel refers to the extended area that is generally orthogonal to the axis of the wheel. The wheel is typically circular, but that is not a requirement for this invention.

Plate—Is defined as a substantially flat, extended section that is rotatable, that is part of a wheel, and that rotates with the wheel.

Template—Is defined as a layer of solid material that has an uneven surface, that is part of a wheel, and that rotates with the wheel. The template is positioned between the plate and the means for drawing upon (e.g. paper) when the instrument is in use.

Uneven (adjective) surface—Is defined as a surface which is not totally flat. The unevenness (noun) may result from protrusions on the surface, depressions on the surface, or from holes passing through the section containing that surface.

SUMMARY OF THE INVENTION

The object of this invention is to provide an instrument and a method for rapidly producing colorful designs on paper or on other material. It is intended for use by young children as well as by adults, and accordingly, the instrument must be very simple to operate. Basically, the instrument of the present invention works as follows. A sheet of paper, or other material suitable for drawing upon, is attached to the surface of a wheel which can be rotated rapidly. A pen is applied to the rotating paper. If the pen is held stationary while the paper is rotating, a circle is generated unless the pen happens to be right on the axis of rotation, in which case a point is produced. If the pen is moved radially while the wheel is rotating, a spiral is formed; the clarity of the spiral depends on the relative speed of radial movement of the pen and the angular velocity of the wheel. Depending on how rapidly the pen is moved in a radial direction, or on how many such "sweeps" of the pen are made, the surface of the paper may be completely or only partially colored by the pen. In addition to the designs themselves being pleasant, the act of producing them is also attention-getting and interesting; the designs appear rapidly before one's eyes.

Many types of designs may be produced with this device. A clear spiral may be generated by moving the pen radially while the paper is rotating. If the spacing between successive revolutions of the spiral is close, the spiral may not be immediately evident and the design may appear to consist of a series of concentric circles. For convenience in this specification, such patterns will be referred to as circles even though, strictly speaking, they consist of spirals. Successive concentric circles or rings may be made in different colors. By changing the position of the paper between the formation of successive circles, non-concentric circles may be generated.

If the surface of the wheel to which the paper is attached is totally flat, the pen produces continuous lines on the rotating paper, all parts of which are essentially of the same intensity (However, because the speed of a point on a rotating object increases linearly with distance from the center of rotation, the pen may be in contact with segments of the paper for shorter periods as the distance from the axis increases. This may cause the design to be lighter as the distance from the center of rotation increases). If the surface underlying the paper is uneven (due to protrusions and depressions, or holes through the wheel), then the lines are discontinuous or at least of varying intensity from point to point. This feature greatly increases the design-making capabilities of the device. This effect occurs because the pen makes firm contact with the paper at points where the underlying surface is elevated and makes more gentle contact at points where the underlying surface is depressed, or where there are holes through the underlying wheel. If the underlying surface contains a pattern consisting of protruding and depressed regions, or a pattern due to holes in the wheel, an "image" of that pattern is transferred to the paper. The unevenness of the underlying surface does not have to be very pronounced in order to function in the above manner. For example, a design produced by cutting holes in a sheet of regular typing paper may be transferred to an overlying sheet of paper in this instrument. Also, creases in a sheet of paper, produced by folding it over and opening it up again, appear as clear lines on a sheet of overlying paper in this instrument. Accordingly, the instrument is capable of producing an unlimited number of designs.

The versatility of the instrument of the present invention is increased further by being able to rotate the wheel both clockwise and counterclockwise. Parts of the pattern on an underlying surface are transferred to the overlying paper when the paper is rotating clockwise but not counterclockwise; other parts of the pattern are transferred to the paper when the wheel is rotating counterclockwise but not clockwise. In such cases, interesting effects are produced by using, say, a red pen for clockwise rotation and a green pen for counterclock wise rotation.

OBJECTS AND ADVANTAGES OF THE INVENTION

In accordance with the above-presented summary of the invention, and a further description of the invention which will follow, it is the primary object of this invention to provide a design-making instrument for producing colorful designs by applying a pen or other drawing means to a rotating sheet of paper or other material.

Another object of this invention is to provide an instrument for producing circular-based and spiral-based designs on paper or other material.

Another object of this invention is to provide a facile means for transferring an image of a pattern from a template to a sheet of paper or other material.

Another object of this invention is to provide an instrument for producing pleasant designs rapidly.

Another object of this invention is to provide an instrument that allows children with little or no artistic talent to produce attractive and pleasing designs.

Another object of this invention is to provide a facile means for mixing colors on paper.

Still another object of the present invention is to provide a means for producing marbleized-style designs on paper.

Yet another object of this invention is to provide a design-making instrument that is very versatile in the types of designs it can produce.

Another object of this invention is to provide a design-making instrument based on a rotating wheel where the designs produced vary with the direction of rotation of the wheel.

Another object of this invention is to provide a design-making instrument where the act of producing the designs is attention-getting and interesting to children.

Another object of this invention is to provide a design-making instrument that involves interactive participation by the user.

Still another object of this invention is to provide a design-making instrument that is neat and clean to use.

These and other objects and advantages of the present invention will become apparent to those skilled in the art upon reading the details of construction and use as more fully set forth below, reference being made to the accompanying drawings forming a part hereof, wherein like numerals refer to like parts throughout.

REFERENCE NUMERALS IN DRAWINGS

| | | | |
|---|---|---|---|
| 1. | design-making instrument | 2. | wheel |
| 3. | axle | 4. | motor |
| 5. | motor housing | 6. | base |
| 7. | wall | 8. | battery |
| 9. | conducting wire | 10. | switch |
| 11. | battery compartment | 12. | compartment bottom |
| 13. | compartment side | 14. | sheet of paper |
| 15. | pen | 16. | operator's hand |
| 17. | protrusion | 18. | recession |
| 19. | hole | 20. | clip |
| 21. | cabinet | 22. | drawer |
| 23. | knob | 24. | plate |
| 25. | template | 26. | pulley |
| 27. | string | 28. | ring |
| 29. | rack | 30. | pinion |
| 31. | grip | 32. | key |
| 33. | ball-bearing | 34. | handle |
| 35. | crease | 36. | pin-pricked holes |
| 37. | lug | 38. | cavity |

DESCRIPTION OF THE PRESENTLY-PREFERRED EMBODIMENTS

Before the present invention is described in detail in terms of its preferred embodiments, it is to be understood that this invention is not limited to the particular arrangement of parts shown, as such devices may, of course, vary. It is also to be understood that the terminology used herein is for the purpose of describing particular embodiments only, and is not intended to be limiting.

Figure 1:
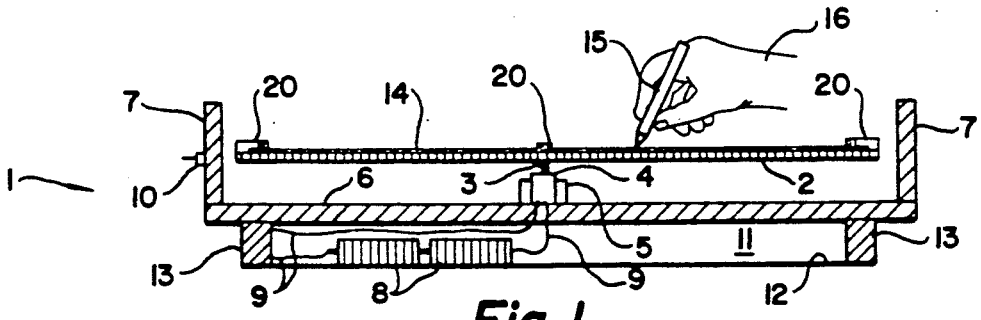
FIG. 1 shows a cut-away front perspective view of one embodiment of the design-making instrument of the present invention.
Figure 2:
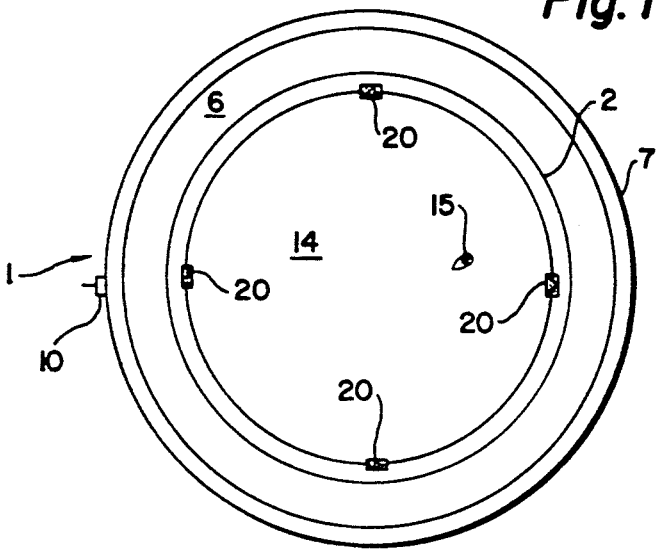
FIG. 2 shows a top view of the embodiment in FIG. 1.

Referring to FIGS. 1 and 2, the design-making instrument of the present invention is designated generally by the numeral 1. It comprises a wheel 2 attached to the axle 3 of a motor 4 that in mounted is housing 5. The wheel 2 may be permanently attached to the axle 3, or it may be attached in a demountable manner. The wheel 2 in this invention is preferably circular, but may be made in other shapes also. The motor-housing 5 is supported on base 6 of the device. The wall 7 is optional. One or more batteries 8 are connected through wires 9 to the motor 4 and switch 10. Compartment 11 with bottom 12 and side 13 houses the batteries 8. Instead of using batteries 8, the motor 4 may also be powered from the mains, using an appropriate transformer and rectifier if needed.

The device is operated as follows. A sheet of paper (or other material suitable for drawing upon) 14 is attached to the surface of wheel 2. Wheel 2 with attached paper 14 is rotated (relative to base 6) by turning ON the switch 10. A pen 15, which is preferably held in the user's hand 16, is then applied to the rotating paper 14. If the pen 15 is held stationary, a circle appears on the paper, unless the pen happens to be right on the axis of rotation, in which case point is produced. If the pen 15 is moved radially, a spiral is produced. If the pen 15 is moved rapidly, the spiral form is very evident (assuming that the wheel 2 is spinning rapidly); on the other hand, if the pen 15 is moved slowly, the spiral form may not be quite so evident, and the design may resemble a set of closely-spaced or touching circles. The pen 15 does not have to be moved in a straight line or be confined to an exactly radial path; all that is required is that the distance of the pen 15 from the center of rotation changes.

The optional wall 7 is convenient for resting one's hand upon while drawing. Concentric rings may be made by removing the pen 15 from the paper periodically while the pen is being moved toward or away from the center. Multicolored designs may be made by using pens of different colors at different radial distances. Overlap of different colors produces interesting effects from the mixing of those colors. Some of the designs have a three-dimensional appearance.

Not only are the designs that are produced pleasant in appearance, but the act of producing them is also interesting; the designs appear rapidly before one's eyes. When the design is complete, the pen is removed from the paper, the switch is turned OFF, and the wheel 2 is allowed to stop.

If the surface immediately underlying the paper 14 is completely flat, the lines that are produced are continuous. However, if the underlying surface is uneven, the lines produced are not continuous or at least of varying intensity. This is because the pen makes firm contact with the paper at points where the underlying surface is protruding and makes less firm contact where that surface is recessed. Thus, if the underlying surface contains a pattern consisting of elevated and depressed regions or of holes in the face of the wheel, an image of that pattern is transferred to the overlying paper.

Figure 3:
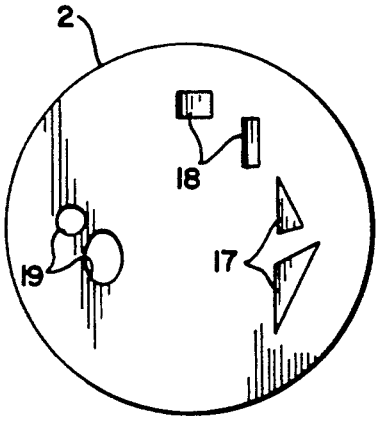
FIG. 3 shows a top view of one embodiment of the wheel in FIG. 1.

FIG. 3 shows a top view of a wheel 2. The face of wheel 2 on the side opposite to the base 6 (see FIG. 1) is uneven due to the presence of protrusions 17 and depressions 18 on this surface, and the presence of holes 19 in wheel 2. The wheel 2 in FIGS. 1-3 is unitary; alternatively, the wheel may be comprised of a plate with a superimposed template that is changeable.

The switch 10 may be of various types. For example, the switch 10 may be a simple ON/OFF switch. Alternatively, it may be a three-way switch where the center position is OFF, the left position is CLOCKWISE, and the right position is COUNTERCLOCKWISE. In such a case, the right position of the switch may be used as a brake following clockwise rotation, and the left position may be used as a brake following counterclockwise rotation. A mechanical braking means may also be used for slowing down the rotating wheel after turning the motor OFF.

The paper 14 may be attached to wheel 2 by any of various means such as by using adhesive tape. In FIGS. 1 and 2, the paper 14 is attached to wheel 2 by inserting the paper under four clips 20 that are attached to wheel 2. The paper sheet may be of any shape; square or circular sheets are most convenient. When paper which has been crumpled and then flattened out again is used for drawing upon with this instrument the resulting design resembles marbleized paper.

Figure 4:
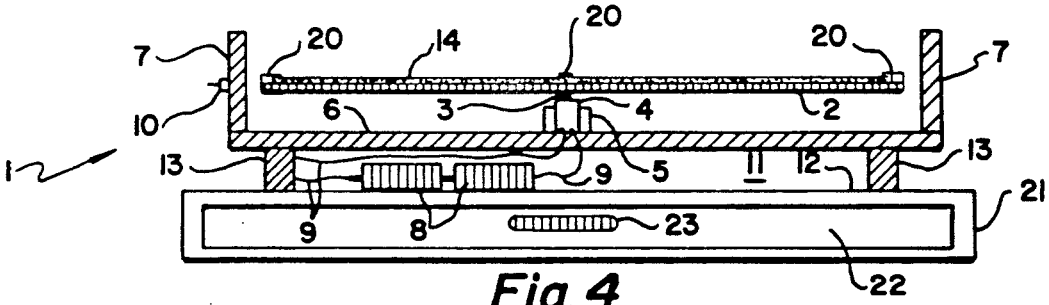
FIG. 4 shows a cut-away front perspective view of another embodiment of the invention.
Figure 5:
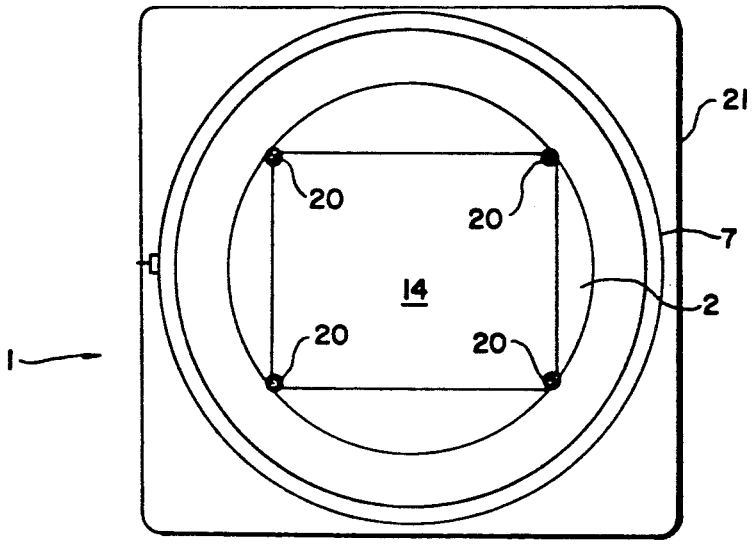
FIG. 5 shows a top view of the embodiment in FIG. 4.

The embodiment of the design-making instrument shown in FIGS. 4 and 5 is similar to that in FIGS. 1 and 2, except that it has a cabinet 21 for storing pens, paper, wheels, and templates. The cabinet 21 contains a drawer 22 with a knob 23.

Figure 6:
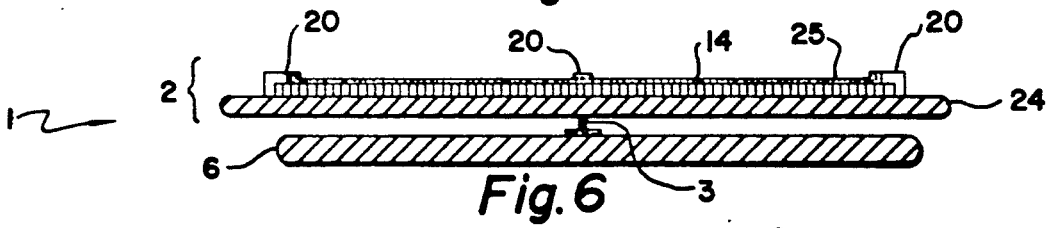
FIG. 6 shows a side-view of another embodiment of the invention.

The embodiment shown in FIG. 6 does not have a motor and the wheel 2 can be rotated by hand. This version resembles a "lazy Susan"-type device, consisting of a wheel 2 connected to a base 6 by means of a swivel device or axle 3. In FIG. 6, the wheel 2 consists of a plate 24 with a superimposed template 25. Paper 14 is attached to the plate 24 using clips 20 so that the paper 14 lies on top of the template 25. The wheel 2 is rotated manually, and the designs are produced as described above for the other embodiments. The template-cum-plate combination of FIG. 6 can be used with the other embodiments also.

The unevenness of the underlying surface does not have to be very pronounced in order for an image to be produced on the overlying sheet of paper. For example, a pattern consisting of holes in a sheet of regular typing paper is sufficiently pronounced to be transferred to the overlying paper in this matter. Templates having patterns consisting of elevated and recessed regions or of holes, allow an unlimited number of designs to be produced.

Regular typing paper is sufficiently flexible to allow designs from the underlying surface to be reproduced (i.e. regular typing paper is suitable for drawing upon with this instrument), whereas stiffer materials such as cardboard will generally not work for this purpose. A set of templates allows the user to choose any of a variety of designs or background textures. The user can also prepare his/her own customized templates from a sheet of paper. This may be done by folding a sheet of paper to produce creases and then opening up the paper again; such creases are sufficiently pronounced that an image of the creases is readily transferred to the overlying paper in the instrument of the present invention. Templates can also be made by pricking holes in the form of a pattern in a sheet of paper with a pin. Stars, hearts, geometric shapes, etc. may be cut from a sheet of paper or plastic and placed on the plate and underneath the paper to be drawn upon; an image of those patterns is transferred to the overlying paper. Also, the sheet of paper or plastic from which the various shapes have been cut can serve as templates in the instrument of the present invention. Numbers, letters, and printed messages may be transferred from a template to an overlying sheet of paper in this manner.

When templates are used, or when the wheel itself has an uneven surface, different design may be produced from clockwise and counterclockwise rotations. This is because different parts of the underlying template make firm contact with the paper during clockwise and counterclockwise rotations of the wheel. For example, if a red. pen is used for clockwise rotation in such a case, and a blue pen for counterclockwise rotation, parts of the resulting design will be red and other parts will be blue.

Figure 7:
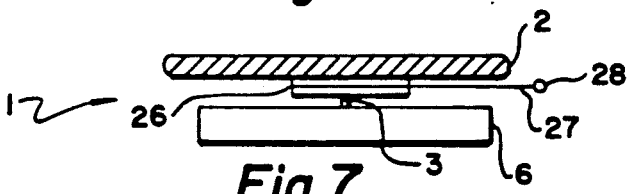
FIG. 7 shows a side-view of another embodiment of the invention.

The embodiment shown in FIG. 7 is similar to that in FIG. 6, but it also contains a pulley-type component 26 around which is wound a string 27. When the string 27 is pulled, the wheel 2 rotates, and it continues to spin, due to its angular momentum, after the string 27 is released. A ring 28 is used for gripping the string 27. The string 27 may be wound around the pulley 26 without being permanently attached to it; in this case, the string 27 detaches from the pulley each time that the wheel 2 is rotated, and the string must be manually rewound each time. Alternatively, the string may be automatically rewound by a spring-type mechanism, and the wheel allowed to continue spinning after the string is released. A "free-wheel" type mechanism may be used to accommodate this action.

Figure 8:
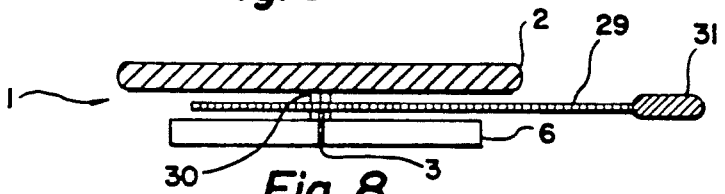
FIG. 8 shows a side-view of another embodiment of the invention.

The embodiment shown in FIG. 8 is similar to that in FIG. 7, except that instead of a string, the rack 29 is used to rotate the pinion 30 which is attached directly to the wheel 2 and is rotatably connected to axle 3. The rack 29 may be rigid or may be flexible. The rack 29 may be detachable from the main body of the device, in which case it is manually re-engaged with the pinion 30 each time that the wheel is to be rotated. Alternatively, the rack 29 may be automatically retracted by a spring-type mechanism each tiem that it is used, and the wheel 2 allowed to continue spinning by a free-wheel type mechanism. A grip 31 is attached to one end of the rack 29 for holding it.

Figure 9:
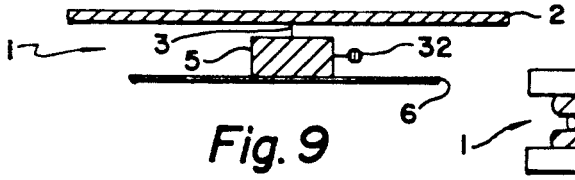
FIG. 9 shows a side-view of another embodiment of the invention.

In the embodiment shown in FIG. 9 the wheel 2 is propelled by a spring-powered motor contained in the housing 5 and wound by the key 32. This device may also contain a reversing mechanism to allow the wheel 2 to be rotated in either direction.

Figure 10:
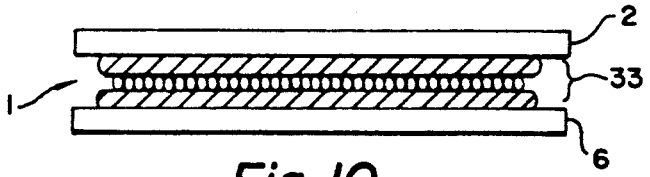
FIG. 10 shows a side-view of another embodiment of the invention.
Figure 11:
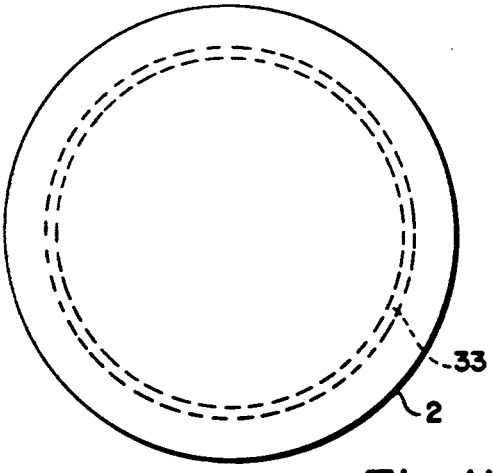
FIG. 11 shows a top-view of the embodiment in FIG. 10.

In the embodiment shown in FIGS. 10 and 11, the wheel 2 is rotatably connected to the base 6 by a ball-bearing 33. In FIG. 11, the ball-bearing 33 that is positioned between the wheel 2 and base 6, is shown in outline.

Figure 12:
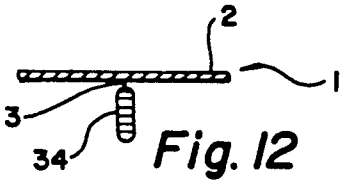
FIG. 12 shows a side-view of another embodiment of the invention.

FIG. 12 shows an embodiment of the invention designed to be held in one's hand while making designs. The user holds the base or handle 34 in his/her hand and rotates the wheel 2 using the thumb of that hand or by using the other hand. Wheel 2 is rotatably connected to handle 34 by axle 3.

Figure 13:
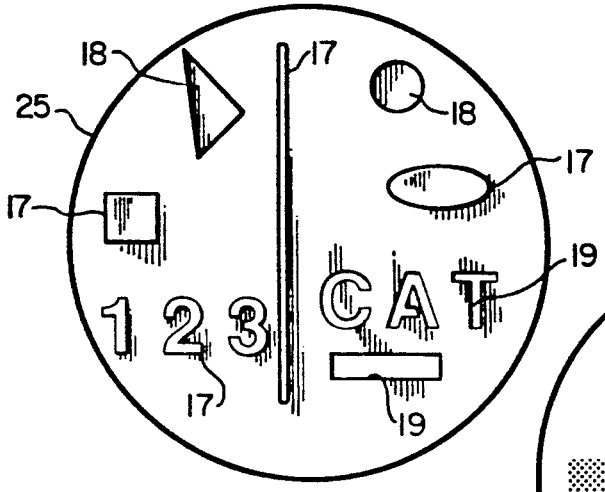
FIG. 13 shows a top-view of an embodiment of a template that can be used with the present invention.

FIG. 13 shows an embodiment of a template 25 that can be used with the design-making instrument of the present invention. The template 25 consists of a sheet-like material having an uneven surface resulting from elevated sections 17, recessed sections 18, and holes 19. Images of these elevated and recessed regions are transferred to a sheet of overlying paper with this instrument. The template 25 may be made from plastic, paper, or some other suitable material.

Figure 14:
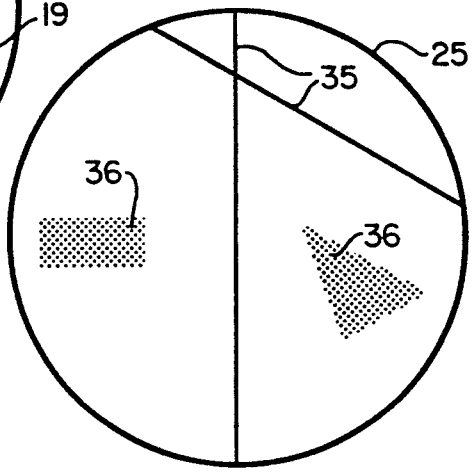
FIG. 14 shows a top-view of another embodiment of a template for the present invention.

FIG. 14 shows a template 25 made from a sheet of paper or other suitable material, having creases 35 made by folding the paper and opening it up again. Template 25 also contains sections consisting of small holes 36 produced by prickling the paper with a pin or the like. Images of the creases 35 and of the pin-pricked holes 36 are transferred to a sheet of overlying paper with this instrument.

Figure 15:
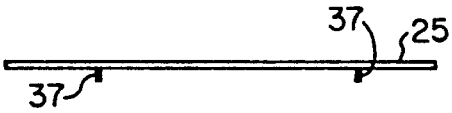
FIG. 15 shows a side-view of an embodiment of a template for the present invention.
Figure 16:
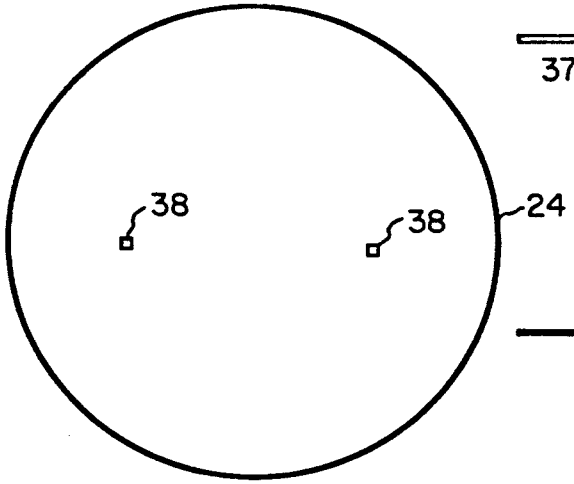
FIG. 16. shows a top-view of an embodiment of a plate for use with the template of FIG. 15.

Templates 25 may be attached to the underlying plate 24 in various ways. In the case of a paper template, the template 25 may simply lie upon the surface of plate 24, and it will be held in position by the overlying paper sheet 14. FIG. 15 shows an embodiment of a template 25 having lugs 37 that protrude from its lower surface. Lugs 37 are inserted into the cavities 38 of plate 24 in FIG. 16. The overlying sheet of paper 14 then holds the template 25 in place, and lugs 37 prevent the template from slipping. The cavities 38 in FIG. 16 are square in cross-section but any other shape will also suffice. A single lug 37 and cavity 38 is sufficient if both have noncircular cross-sections.

Figure 17:
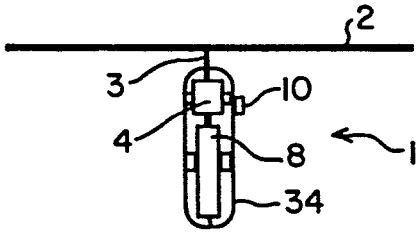
FIG. 17 shows a side-view of another embodiment of the present invention.

FIG. 17 shows another embodiment of the present invention similar to that in FIG. 12, except that it is motor-driven. The wheel 2 is connected through axle 3 to the motor 4. The handle 34 houses the motor 4 and battery 8. The switch 10 controls the power from the battery 8 to the motor 4.

Figure 18A:
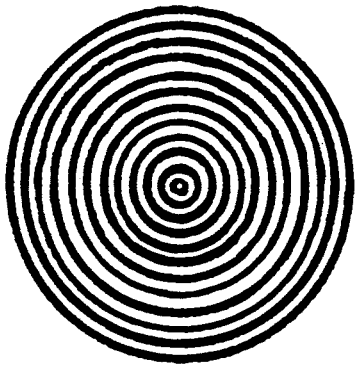
FIG. 18A shows a design consisting of a set of concentric circles produced by the instrument of the present invention where the paper was superimposed on a flat surface.
Figure 18B:
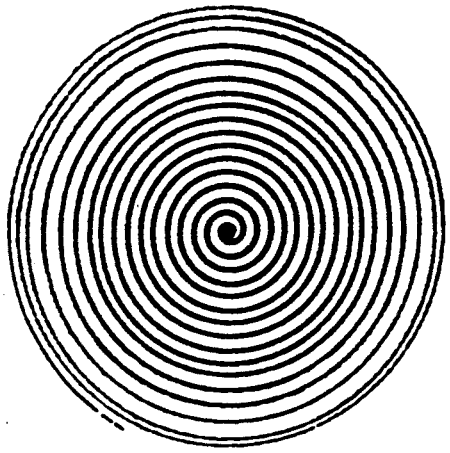
FIG. 18B shows a design consisting of a spiral produced by the instrument of the present invention where the paper was superimposed on a flat surface and the paper was rotated in a clockwise direction while the pen was moved from the center of rotation outwards.
Figure 18C:
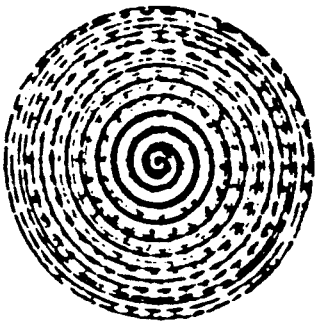
FIG. 18C shows a design consisting of a spiral produced by the instrument of the present invention where the paper wsa superimposed on a surface having a rectangular array of protruding points, and the paper was rotated in a counterclockwise direction while the pen was moved from the center of rotation outwards.
Figure 18D:
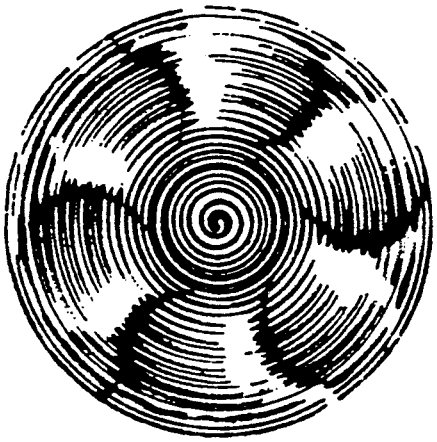
FIG. 18D shows a design produced by the instrument of the present invention where the paper was superimposed on a template having six circular holes, and the paper was rotated in a counterclockwise direction while the pen was moved from the center of rotation outwards.
Figure 18E:
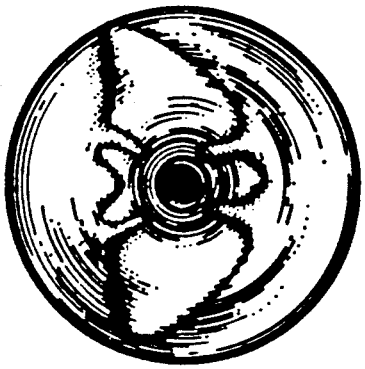
FIG. 18E shows a design produced by the instrument of the present invention where the paper was superimposed on a template consisting of a paper cut-out in the shape of a dove, and the paper was successively rotated in both directions.
Figure 18F:
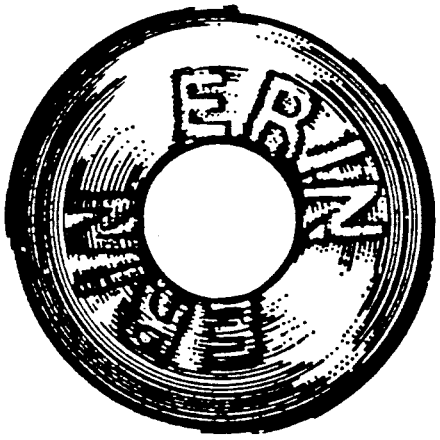
FIG. 18F shows a design produced by the instrument of the present invention where the paper was superimposed on a template containing protruding vinyl letters forming the word "ERIN" twice."

FIGS. 18A–18F shows examples of designs produced by the design-making instrument of the present invention. These designs are illustrated in black-and-white, but in reality the designs may be multicolored, exhibit a wide variety of shades, and show interesting effects due to the overlapping of colors. FIG. 18A shows a set of concentric circles producec on this instrument without the use of an underlying template (i.e. where the surface underlying the paper was flat). FIG. 18B shows a spiral, and FIG. 18C shows another spiral where the wheel was rotating in the opposite direction compared to that for the spiral in FIG. 18B. FIG. 18D shows a design produced using a plastic template, and FIG. 18E shows a design produced using a paper template. FIG. 18F shows a design consisting of letters produced on this instrument.

Various types of pens, pencils, crayons or other drawing or painting means may be used with the design-making instrument of the present invention, and these are referred to generally as drawing means in the claims. Felt-tipped markers (such as Dennison's MARKS-A-LOT® and HI-LITER® markers, and Sanford's SHARPIE® and VIS-A-VIS® markers) work particularly well. Broad-tipped or pointed marker pens may be used, and each type of pen produces a somewhat different style of design. Broad-tipped pens may be used to produce both thick and narrow lines. Ballpoint pens can also be used to produce designs with this invention.

If designs are produced on a sheet of transparent plastic instead of on paper, they can be projected onto a wall or screen with an overhead projector. Some sheets of transparent plastic are not sufficiently flexible to allow designs from underlying templates to be transferred to the plastic, but are suitable for producing designs based simply on circles and spirals. On the other hand, some plastic sheets are sufficiently flexible to allow designs from underlying templates to be reproduced on the plastic. For example, the inventor has prepared images of designs from underlying templates on sheets of cellophane, polyethylene, and polypropylene using the design-making instrument of the present invention.

In the discussion above, it has been described how movement of the pen on the surface of the rotating paper can lead to various designs. It is actually relative motion of the pen with respect to the center of rotation of the rotating paper that is important. Designs could also be produced by shifting the center of rotation of the rotating paper while the pen is maintained stationary, but in general this is not as convenient.

In a preferred embodiment of the present invention, a motor capable of relatively high speeds was used. A Mabuchi RE-36 motor (purchased from Edmund Scientific Company, Barrington, N.J.), powered by two 1.5V batteries in series, and capable of no-load speeds up to 10,000 RPM, was used to drive the wheel. A low-torque motor such as this is desirable for use with the present invention; the low torque allows the rotating wheel to be readily stopped by the user's hand, and avoids causing injury if the user's hand happens to become engaged with the spinning wheel.

The instant invention is shown and described in what are considered the most practical and preferred embodiments. It is recognized, however, that departures may be made therefrom which are within the scope of this invention, and that obvious modifications will occur to one skilled in the art upon reading this disclosure.

I claim:

1. A design-making instrument, comprising;

a wheel having a first face and a second face;

said first face having at least one depression, protrusion, or hole therein;

said wheel rotatable about an orthogonally disposed axis;

said second face rotatably connected to a base for rotatably supporting said wheel;

a rotating means for rotating said wheel relative to said base;

a sheet of material for drawing upon, said sheet attached to said first face of said wheel; and a drawing means for drawing on said sheet while said wheel is rotating, wherein:

said sheet is sufficiently flexible to allow an image of said at least one depression, hole, or protrusion to be transferred to said sheet when said drawing means is applied to said sheet and moved in a substantially radial manner while said wheel is rotating and whereby said image is superimposed on a generally circular background pattern.

2. The design-making instrument of claim 1, further comprising:

an axle mounted on said base, wherein said wheel is centrally connected to said axle, whereby said wheel is rotatable relative to said base.

3. The design-making instrument of claim 1, further comprising:

a ball-bearing mounted on said base, wherein said wheel is connected to said ball-bearing, whereby said wheel is rotatable relative to said base.

4. The design-making instrument of claim 1, wherein:

said rotating means for rotating said wheel is a motor that is mounted on said base;

wherein said motor contains an axle; and wherein said wheel is centrally connected to said axle of said motor.

5. The design-making instrument of claim 1, further comprising:

a holding means attached to said wheel for holding said sheet of material to said wheel.

6. A design-making instrument, comprising:

a wheel having a first face and a second face;

a template removably attached to said first face;

said template having at least one depression, protrusion, or hole, therein;

said wheel rotatable about an orthogonally disposed axis;

said second face rotatably connected to a base for rotatably supporting said wheel;

a rotating means for rotating said wheel relative to said base;

a sheet of material for drawing upon, said sheet attached to said template; and a drawing means for drawing on said sheet while said wheel is rotating, wherein:

said sheet is sufficiently flexible to allow an image of said at least one depression, protrusion or hole, to be transferred to said sheet as the drawing means is applied to said sheet and moved in a substantially radial manner while said wheel is rotating, and whereby said image is superimposed on a generally circular background pattern.

7. The design-making instrument of claim 6, further comprising:

a plurality of lugs, said lugs protruding from the surface of said template that is adjacent to said first face, and wherein;

said first face comprises a plurality of cavities, whereby said lugs engage with said cavities.

8. The design-making instrument of claim 6, further comprising:

a lug, said lug protruding from the surface of said template that is adjacent to said first face, and wherein;

said first face comprises a cavity, whereby said lug engages with said cavity.

9. The design-making instrument of claims 1 or 6, further comprising:

an elevated section attached to said base, and rising substantially orthogonally therefrom, said elevated section circumferentially surrounding said wheel, at least in part.

10. A method of making designs in which a drawing means is applied to a sheet of paper or the like that is rotated, wherein:

said paper is mounted on a template comprising at least one depression, protrusion, or hole, wherein;

said template rotates with said paper, whereby an image of said at least one depression, protrusion, or hole is transferred to said paper as the drawing means is moved in a substantially radial direction, and wherein said image is superimposed on a generally circular pattern.

11. The method of making designs of claim 10, wherein said paper is rotated in one direction, then stopped, and then rotated in the other direction.

12. A method of making designs, using a device comprising a base, a wheel having a first face and a second face, said base rotatably connected to said second face, said first face comprising at least one depression, protrusion, or hole, said device used in association with a sheet of paper or the like and a drawing means, comprising the steps of:

attaching said sheet of paper or the like to said first face;

rotating said wheel with said paper attached to said wheel;

applying said drawing means to said paper while said paper is rotating;

moving said drawing means in a substantially radial direction;

whereby an image of said at least one depression, protrusion, or hole is produced on said paper and wherein said image is superimposed on a generally circular pattern.

13. The method of claim 12, further comprising the steps of:

removing said drawing means from said paper;

stopping the rotation of said wheel;

rotating the wheel in the opposite direction to its original direction of rotation; and, applying the drawing means to said rotating wheel again, whereby a design is produced on said paper that is different from the design produced using the original direction of rotation of said wheel.

* * * * *